US008647408B2

(12) United States Patent
Kara et al.

(10) Patent No.: US 8,647,408 B2
(45) Date of Patent: Feb. 11, 2014

(54) INDICATOR DEVICE FOR A FILTER, VACUUM CLEANER, AND METHOD OF FILTERING A VACUUM CLEANER EXHAUST STREAM

(75) Inventors: Seyfettin Kara, Spenge (DE); Monika Seifert, Detmold (DE); Stefan Tiekoetter, Bielefeld (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 233 days.

(21) Appl. No.: 13/094,883

(22) Filed: Apr. 27, 2011

(65) Prior Publication Data

US 2011/0271832 A1 Nov. 10, 2011

(30) Foreign Application Priority Data

May 5, 2010 (DE) ..... 10 2010 016 789

(51) Int. Cl.
*B01D 46/30* (2006.01)

(52) U.S. Cl.
USPC ..... 95/14; 15/339; 96/420; 116/216; 55/DIG. 3; 55/DIG. 34

(58) Field of Classification Search
CPC ..... B01D 39/00; B01D 41/00; B01D 45/00; B01D 46/00; B01D 49/00; B01D 50/00; B01D 51/00; B01D 46/30
USPC ..... 15/339; 95/25; 96/417, 420, 423; 116/200, 216
See application file for complete search history.

(56) References Cited

U.S. PATENT DOCUMENTS

| | | | | |
|---|---|---|---|---|
| 6,026,539 | A * | 2/2000 | Mouw et al. | 15/339 |
| 6,916,116 | B2 * | 7/2005 | Diekmann et al. | 374/102 |
| 7,303,613 | B2 * | 12/2007 | Rosenzweig | 96/421 |
| 7,509,707 | B2 * | 3/2009 | Pullins | 15/339 |
| 8,263,017 | B2 * | 9/2012 | Stewart et al. | 422/400 |
| 2004/0240324 | A1 | 12/2004 | Isbitsky et al. | |
| 2006/0011124 | A1 * | 1/2006 | Odashiro | 116/219 |
| 2007/0180649 | A1 * | 8/2007 | Pullins | 15/339 |

FOREIGN PATENT DOCUMENTS

| | | | |
|---|---|---|---|
| DE | 10229796 | A1 | 1/2004 |
| DE | 60205753 | T2 | 6/2006 |

* cited by examiner

*Primary Examiner* — Duane Smith
*Assistant Examiner* — Sonji Turner
(74) *Attorney, Agent, or Firm* — Leydig, Voit & Mayer, Ltd.

(57) ABSTRACT

An indicator device for a filter includes a filter replacement indicator that is actuatable by thermal expansion. The indicator device can be included in a filter. Also, a vacuum cleaner including a filter having the indicator device.

14 Claims, 2 Drawing Sheets

INDICATOR DEVICE FOR A FILTER, VACUUM CLEANER, AND METHOD OF FILTERING A VACUUM CLEANER EXHAUST STREAM

CROSS REFERENCE TO RELATED APPLICATIONS

This application claims priority to German Patent Application No. DE 10 2010 016 789.4, filed on May 5, 2010, which is hereby incorporated by reference herein in its entirety.

FIELD

The present invention relates to an indicator device for a filter, in particular a filter which functions as a vacuum cleaner exhaust filter.

BACKGROUND

Vacuum cleaners, in particular electric vacuum cleaners designed for use in the home, nearly exclusively use multi-stage particulate filters. Typically, a pre-filter, preferably in the form of a dust bag, is provided upstream of a vacuum cleaner fan, and an exhaust filter is disposed downstream thereof to remove fine dust that has passed through the dust bag. The exhaust filter also collects, for example, the particles which are abraded from the carbon brushes or the like of the drive motor of the fan. Both filter stages are consumable items, which need to be replaced by a user of the vacuum cleaner. To this end, it is helpful to give the user a reliable and usage-based indication of when the bag or the exhaust filter needs to be replaced as a result of an upper limit for the filling level or saturation being reached. For the dust bag, it is common to use sensors which operate based on the differential pressure principle. For the exhaust filter, the time of use of the filter can be used as a criterion for determining when replacement is necessary. For this purpose, a time counter may be used which is manually reset by the user after insertion of the exhaust filter and which, after a predetermined operating time has elapsed, indicates that the filter needs to be replaced. The algorithm and the controls and indicators needed for this are implemented in and form part of a vacuum cleaner control system.

German Patent Publication DE 102 29 796 describes a filter having a usage indicator which operates based on temperature-dependent integration. The color of the indicator changes in a temperature-dependent manner each time the vacuum cleaner is used for a prolonged period of time. German Patent Publication DE 602 05 753 T2 describes time-dependent usage indicators which need to be activated by a user by opening a liquid reservoir. A colored indicator liquid diffuses into an absorbent material which is provided in the usage indicator and which then changes color as a function of time and, therefore, is a measure for the period of use.

FIG. 1 shows a conventional vacuum cleaner 10 having a dust chamber 12 in which may be positioned a dust bag 14. Dust 18 is conveyed through a suction hose 16 to dust bag 14 and collected therein. Dust 18 is transported by air flow 20, which is generated by a fan 22 (vacuum cleaner fan). Dust chamber 12 is closed by a dust chamber cover 24. Finer fractions of dust 18, which pass through dust bag 14, are carried into a vacuum cleaner exhaust filter 26 by the exhaust air or vacuum air flow 20 of fan 22.

Vacuum cleaner 10 includes a control processor 28, which is in operative connection with a control and display unit 30 disposed on vacuum cleaner 10. The signals from control and display unit 30 are used by control processor 28 to adjust the suction power of fan 22, and thus, the amount of dust 18 that can be picked up by vacuum cleaner 10.

In some designs of vacuum cleaners 10, an indication of an upcoming need to replace vacuum cleaner exhaust filter 26 is provided by control and display unit 30 based on, for example, the accumulated operating time of vacuum cleaner 10, which is determined by control processor 28. In a vacuum cleaner 10 having such a function, the operating time meter is reset via control and display unit 30 after replacement of vacuum cleaner exhaust filter 26.

However, when the time of use is used as a criterion for determining when a filter needs to be replaced, the load actually placed on the filter is not, or not optimally, taken into account, because the linear time progression alone is not able to reproduce the actual usage behavior, which varies over time.

SUMMARY

In an embodiment, the present invention provides an indicator device for a filter including a filter replacement indicator that is actuatable by thermal expansion. In another embodiment, a filter includes the indicator device. In another embodiment, a vacuum cleaner includes the filter having the indicator device. In another embodiment a filter having the indicator device is used in a vacuum cleaner.

BRIEF DESCRIPTION OF THE DRAWINGS

Exemplary embodiments of the present invention will be described in more detail below with reference to the drawings. Corresponding objects or elements are identified by the same reference numerals in all figures. It is understood that neither this or any other exemplary embodiment should be construed as limiting the scope of the present invention. Rather, within the framework of the present disclosure, numerous revisions and modifications are possible, in particular such variants, elements and combinations and/or materials, which, for example, by combining or altering individual features or elements or method steps described in connection with the general description and the, or each, particular embodiment, as well as the claims, and contained in the drawings, may be inferred by one skilled in the art, and may lead, through combinable features, to a new subject matter or to new method steps or sequences of method steps, also to the extent they relate to manufacturing testing and operating methods. In the drawings:

DETAILED DESCRIPTION

Figure 1:
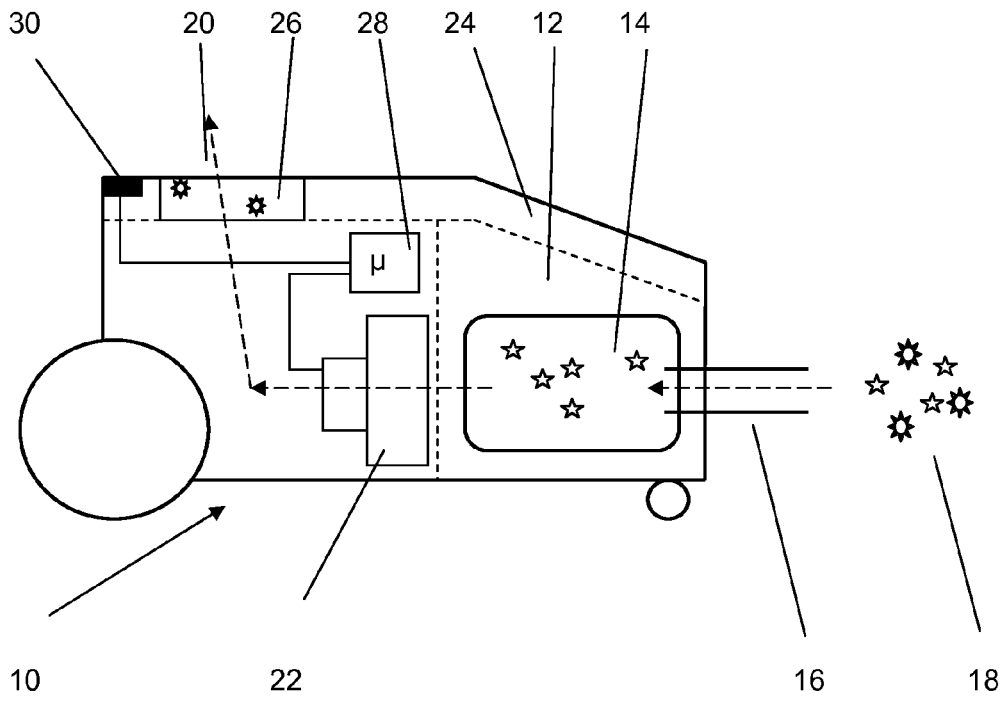
Fig. 1 PRIOR ART
FIG. 1 shows a conventional vacuum cleaner.

In an embodiment, an aspect of the present invention to provide a filter, in particular a vacuum cleaner exhaust filter, configured to generate a filter replacement signal that corresponds to the level of usage or to the degree of saturation.

In an embodiment, the present invention relates to an indicator device for a filter, in particular a filter which functions as a vacuum cleaner exhaust filter. The indicator device is provided to display a degree of saturation of the filter. In another embodiment, the invention relates to a filter having such an indicator device; i.e., to a filter which is combined with an indicator device or a system including the filter and the indicator device. In another embodiment, the present invention relates to a vacuum cleaner having such a filter, and to the use of such a filter as a vacuum cleaner exhaust filter.

In particular, an embodiment of an indicator device for a filter, in particular for a vacuum cleaner exhaust filter, includes a filter replacement indicator which is actuatable, in particular in a mechanical manner, by thermal expansion. When the indicator device is in use; i.e., on a filter which functions as a vacuum cleaner exhaust filter, the heat generated during operation of the vacuum cleaner, in particular the exhaust air heat, is a good measure for a period and manner of use of the filter, so that a filter replacement signal which corresponds to the level of usage; i.e., to the degree of saturation, may be derived from a thermal expansion. In embodiments of the present invention, a filter replacement indicator which is actuatable by thermal expansion is provided for the purpose of such derivation. At a certain heat input introduced; i.e., given a certain period or manner of use, a thermal expansion takes place which results in an actuation of the filter replacement indicator. The filter replacement indicator can be read, for example, by a user, and thus functions as a visual signal to indicate to the user when the filter needs to be replaced.

A filter of the type discussed herein and described below may be, in particular, a vacuum cleaner exhaust filter; i.e., a filter which is disposed in the exhaust air stream of the suction fan of an electric vacuum cleaner and functions, for example, as a fine particulate filter or hygiene filter and which is sometimes also referred to as "exhaust port filter" or "after-filter".

Preferably, the indicator device includes an actuating member which contains a medium capable of thermal expansion and is used for actuating the filter replacement indicator by thermal expansion. The flow of air to be filtered impinges on the actuating member and the indicator device, causing them to heat up during operation, which results in thermal expansion of the medium contained in the actuating member. This thermal expansion is converted by the actuating member into a mechanical actuation of the filter replacement indicator. Although an actuating member of this type operates mechanically, it is simple and requires little maintenance.

Preferably, the actuating member includes an actuating lever which is movable in response to thermal expansion of the medium. The actuating lever provides a particularly simple way of creating mechanical contact between the actuating member and the filter replacement indicator, so that the filter replacement indicator can be actuated by the actuating lever of the actuating member.

The medium used in the actuating member as a medium capable of thermal expansion may be wax. Such a medium responds to an increase in temperature by thermal expansion in a manner sufficient for the intended application. Moreover, a thermally expandable medium such as wax or the like is sufficiently viscous, so that, for example, in the case of an actuating lever movable by wax in response to thermal expansion, no special measures have to be taken for positioning and adjustment thereof.

The filter replacement indicator may be in the form of a counter or the like. When a counter is used as the filter replacement indicator, such counter may count each actuation performed by the actuating member, and when the number of actuations exceeds a predetermined or predeterminable threshold, it may provide an indication informing the user that the filter needs to be replaced. To this end, the counter can assume a position which functions as a changing marking, the counter being configured in such a manner that the changing marking appears after a predetermined number of actuations have been performed by the actuating member. The counter may be adapted to count upwardly or downwardly. When the indicator device, or a filter combinable with such an indicator device, is in its as-delivered condition, the counter is set or settable to an initial configuration correlated with the filter. During operation, each time an actuation is performed by the actuating member, the counter counts upwardly or downwardly until it assumes the position which functions as a changing marking When the counter displays the changing marking, then this acts as a signal to the user that the filter needs to be replaced.

The indicator device of the type discussed herein and described below may in principle be combined with any type of filters. Accordingly, the present invention relates also to a filter having an indicator device of the type discussed herein and described below. In particular, the filter may be what is known as a vacuum cleaner exhaust filter. Overall, therefore, the present invention also relates to vacuum cleaner having such an indicator device or a vacuum cleaner having a filter combined with such an indicator device, in particular a vacuum cleaner exhaust filter having an indicator device which is based on the approach of the present invention. If the filter combined with the indicator device functions as a vacuum cleaner exhaust filter in an exhaust duct of a suction fan of the vacuum cleaner, the thermal expansion for the thermal-expansion-actuated filter replacement indicator is caused by the exhaust air stream of the suction fan during operation of the vacuum cleaner. The exhaust air stream of the suction fan is a good measure for the manner and duration of operation of the vacuum cleaner, and thus for the load placed on the filter. Accordingly, the position of the filter replacement indicator after a number of actuations performed by the actuating member indicates a saturation of the filter or, as the case may be, that the filter has reached a saturation limit.

Finally, therefore, the present invention may also relate to the use of a filter having an indicator device, as discussed herein and described below, as a vacuum cleaner exhaust filter in the exhaust air stream of a suction fan of an electric vacuum cleaner.

Figure 2:
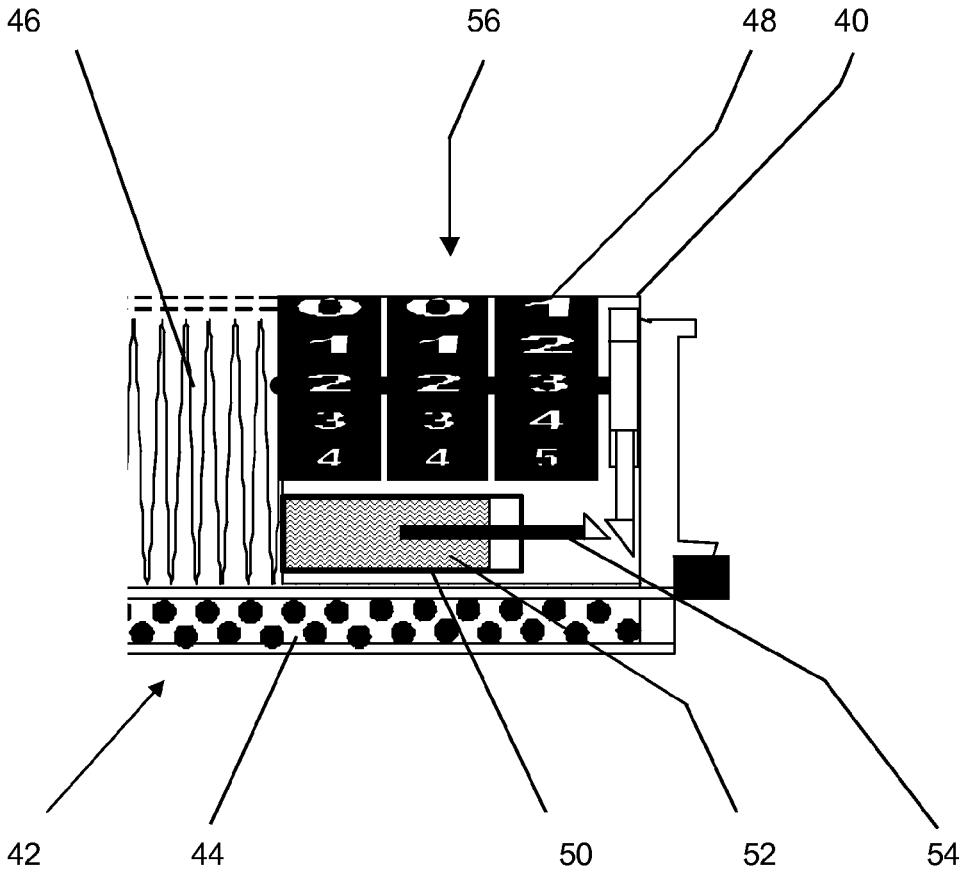
FIG. 2 shows an embodiment of an indicator device with a partially shown filter in accordance with an embodiment of the invention.

FIG. 2 shows an embodiment of an indicator device 40 in a combined configuration with a partially shown filter 42 such as, for example, a vacuum cleaner exhaust filter 26 (FIG. 1). Filter 42 is what is known as a HEPA filter, which has an activated carbon layer 44 on its inlet side and a filter medium 46 downstream of said activated carbon layer. Indicator device 40 is integrated in filter 42 in such as way that it is laterally adjacent to filter medium 46. Indicator device 40 could also be disposed in any other position, such as a position surrounded on all sides by filter medium 46.

Indicator device 40 includes a counter as the filter replacement indicator 48 which is actuatable by thermal expansion. Actuation of filter replacement indicator 48 is accomplished by means of an actuating member 50. This actuating member contains a thermally expandable medium 52, such as wax, which is used for actuating filter replacement indicator 48. An actuating lever 54 is held in thermally expandable medium 52 and, besides that, by a housing of actuating member 50, said actuating lever actuating filter replacement indicator 48 when thermally expandable medium 52 thermally expands to a sufficient extent. In the exemplary embodiment illustrated, there is shown a mating actuating lever forming part of filter replacement indicator 48, said mating actuating lever being operable by actuating lever 54 of actuating member 50 to actuate the filter replacement indicator.

In the embodiment shown, filter replacement indicator 48 is in the form of a counter and, more particularly, in the form of a mechanical counter which counts one step each time an actuation is performed by actuating member 50. In a departure from the illustrated Arabic numerals provided on the counter, it is also possible to use a color code or the like, so that when the counter reaches a predetermined or predeterminable state, three red fields or, depending on the number of rotating disks of the counter, one or more red fields, are visible on a viewing side that functions as a changing indicator 56, said fields in combination representing a filter replacement signal for the user of filter 42.

Embodiments of the present invention thus provide an indicator device 40 for a filter 42, in particular a vacuum cleaner exhaust filter 26, having a filter replacement indicator 48 which is actuatable by thermal expansion, so that the thermal expansion can be used as a measure for the manner and period of use of filter 42, and an actuation, in particular a mechanical actuation, of filter replacement indicator 48 by thermal expansion causes a user-perceivable signal to be generated which is, in particular, in the form of a visual indication and which indicates a degree of saturation or, as the case may be, that filter 42 has reached a saturation limit.

The scope of the invention is defined in the claims and back-references used in the dependent claims refer to the further development of the subject matter recited in the independent claims. In addition, the different claims may include independent inventions, whose creation is independent of the subject matters of the preceding claims, and are not to be understood as renouncing attainment of an independent protection of subject matter for the features thereof. Furthermore, with regard to an interpretation of the claims in the case of a more detailed concretization of a feature in a dependent claim, it is to be assumed that a restriction of said kind is not present in the respective preceding claims.

While the invention has been particularly shown and described with reference to preferred embodiments thereof, it will be understood by those skilled in the art that various changes in form and details may be made therein without departing from the spirit and scope of the invention.

What is claimed is:

1. An indicator device for a filter comprising:

a filter replacement indicator that is actuatable by thermal expansion, and an actuating member including a medium configured to thermally expand so as to actuate the filter replacement indicator, wherein the actuating member includes an actuating lever that is movable in response to thermal expansion of the medium.

2. The indicator device recited in claim 1, wherein the medium includes wax.

3. The indicator device recited in claim 1, wherein the filter replacement indicator includes a counter.

4. The indicator device recited in claim 1, wherein the filter replacement indicator includes a counter configured to assume a first position based on a performing of a predetermined number of actuations by the actuating member.

5. A filter comprising:

an indicator device having a filter replacement indicator that is actuatable by thermal expansion and an actuating member including a medium configured to thermally expand so as to actuate the filter replacement indicator, wherein the actuating member includes an actuating lever that is movable in response to thermal expansion of the medium.

6. The filter recited in claim 5, wherein the filter is configured as a vacuum cleaner exhaust filter.

7. The filter in claim 5, wherein the medium includes wax.

8. The filter recited in claim 5, wherein the filter replacement indicator includes a counter.

9. The filter recited in claim 5, wherein the filter replacement indicator includes a counter configured to assume a first position based on a performing of a predetermined number of actuations by the actuating member.

10. A vacuum cleaner comprising:

a filter including an indicator device having a filter replacement indicator that is actuatable by thermal expansion and an actuating member including a medium configured to thermally expand so as to actuate the filter replacement indicator, wherein the actuating member includes an actuating lever that is movable in response to thermal expansion of the medium.

11. The vacuum cleaner recited in claim 10, further comprising a suction fan and an exhaust duct corresponding to the suction fan, wherein the fitter is disposed in the exhaust duct as an exhaust filter so as to be subject to thermal expansion in response to an exhaust air stream from the suction fan.

12. The vacuum cleaner recited in claim 10, wherein the filter replacement indicator includes a counter.

13. The vacuum cleaner recited in claim 10, wherein the filter replacement indicator includes a counter configured to assume a first position based on a performing of a predetermined number of actuations by the actuating member.

14. A method of filtering an exhaust air stream of a vacuum cleaner, the method comprising:

providing a filter including an indicator device having a filter replacement indicator that is actuatable by thermal expansion and an actuating member including a medium configured to thermally expand so as to actuate the filter replacement indicator, wherein the actuating member includes an actuating lever that is movable in response to thermal expansion of the medium;

disposing the filter in a path of an exhaust air stream of a suction fan of an electric vacuum cleaner; and operating the vacuum cleaner so as to provide the exhaust air stream so as to actuate the filter replacement indicator by thermal expansion.

* * * * *